US007110712B2

(12) United States Patent
Yoon et al.

(10) Patent No.: US 7,110,712 B2
(45) Date of Patent: Sep. 19, 2006

(54) FOREIGN SUBSTANCE PREVENTION UNIT TO PROTECT ELECTRO-PHOTOGRAPHIC PRINTER FROM FOREIGN SUBSTANCES

(75) Inventors: Young-min Yoon, Yongin-si (KR); Byeong-hwa Ahn, Seongnam-si (KR); Se-hyun Lyu, Seoul (KR); Woo-chul Jung, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 29 days.

(21) Appl. No.: 10/928,134

(22) Filed: Aug. 30, 2004

(65) Prior Publication Data

US 2005/0095044 A1 May 5, 2005

(30) Foreign Application Priority Data

Oct. 30, 2003 (KR) ..... 10-2003-0076234

(51) Int. Cl.
*G03G 21/12* (2006.01)
*G03G 21/00* (2006.01)

(52) U.S. Cl. ..... 399/358; 399/360

(58) Field of Classification Search ..... 222/DIG. 1; 399/13, 110, 111, 113, 119, 120, 262, 358, 399/359, 360

See application file for complete search history.

(56) References Cited

U.S. PATENT DOCUMENTS

| | | | | |
|---|---|---|---|---|
| 5,398,098 | A * | 3/1995 | Fukunaga et al. | 399/110 |
| 5,634,186 | A * | 5/1997 | Villalobos-Garcia et al. | 399/360 |
| 7,020,428 | B1 * | 3/2006 | Park et al. | 399/360 |

FOREIGN PATENT DOCUMENTS

| | | |
|---|---|---|
| JP | 11-84968 | 3/1999 |
| JP | 2003-107971 | 4/2003 |
| KR | 1988-12982 | 8/1988 |
| KR | 1991-8512 | 5/1991 |
| KR | 1994-4400 | 3/1994 |

* cited by examiner

*Primary Examiner*—Hoang Ngo
(74) *Attorney, Agent, or Firm*—Stanzione & Kim, LLP

(57) ABSTRACT

A foreign substance prevention unit use with an electro-photographic printer is installed over a waste toner injection hole such that it closes the waste toner injection hole when a photosensitive medium is separated from a main body of the electro-photographic printer, and opens the waste toner injection hole when the photosensitive medium is installed in the main body of the electro-photographic printer. The foreign substance prevention unit is formed of an elastic material.

17 Claims, 7 Drawing Sheets

FOREIGN SUBSTANCE PREVENTION UNIT TO PROTECT ELECTRO-PHOTOGRAPHIC PRINTER FROM FOREIGN SUBSTANCES

CROSS-REFERENCE TO RELATED APPLICATIONS

This application claims the priority of Korean Patent Application No. 2003-76234, filed on Oct. 30, 2003, in the Korean Intellectual Property Office, the disclosure of which is incorporated herein in its entirety by reference.

BACKGROUND OF THE INVENTION

1. Field of the Invention

The present general inventive concept relates to an electro-photographic printer, and more particularly, to an electro-photographic printer having a foreign substance prevention unit, which prevents foreign substances from accidentally going into a waste toner transfer unit of the electro-photographic printer via a waste toner injection hole.

2. Description of the Related Art

In general, an image forming apparatus forms an image on a piece of paper by forming a latent electrostatic image on a photosensitive medium using a light scanning device, transferring the latent electrostatic image onto a printing medium using toner particles to form a toner image, and fusing the toner image onto the printing medium.

Such an image forming apparatus obtains a desired image by transferring a toner image onto the printing medium using a potential difference between the photosensitive medium and an image transfer unit. However, the toner image is not completely transferred from the photosensitive medium to the image transfer unit or from the image transfer unit onto the printing medium, thus leaving some of the toner particles used to form the toner image behind on the photosensitive medium or in the image transfer unit. This residual toner is called waste toner. The waste toner is removed from the photosensitive medium or the image transfer unit by using a cleaning apparatus and then stored in a waste toner container.

FIG. 1 is a side view of a cleaning apparatus 11 and a waste toner injection hole 31 of a conventional electro-photographic printer, and FIG. 2 is a perspective view of the waste toner injection hole 31 of FIG. 1.

Referring to FIGS. 1 and 2, the cleaning apparatus 11 is installed at one side of a photosensitive medium 10 and removes toner residues (waste toner) from a surface of the photosensitive medium 10. The photosensitive medium 10 and the cleaning apparatus 11 can be assembled into one device, which can be installed in or separated from a main body of the conventional electro-photographic printer. When installed in the main body of the conventional elector-photographic printer together with the photosensitive medium 10, the cleaning apparatus 11 is connected to a duct 30 through a waste toner injection hole 31 of a duct 30, which is installed in the main body of the conventional electro-photographic printer. Accordingly, the waste toner removed from the surface of the photosensitive medium 10 by the cleaning apparatus is injected into the waste toner injection hole 31. In FIGS. 1 and 2, reference numeral 20 denotes a bracket installed in the main body of the conventional electro-photographic printer.

When the device, into which the photosensitive medium 10 and the cleaning apparatus 11 are assembled, is separated from the main body of the conventional electro-photographic printer, the waste toner injection hole 31 is exposed to an outside of the printer 30, so that foreign substances may accidentally go into the duct 30 via the waste toner injection hole 31 due to a user's carelessness.

A transfer unit (not shown) is provided in the duct 30 for efficiently transferring the waste toner, which is injected into the duct 30 via the waste toner injection hole 31. Accordingly, if the foreign substances go into the duct 30 via the waste toner injection hole 31, it may adversely affect an operation of the transfer unit, thereby hindering the transfer unit in smoothly transferring the waste toner injected into the duct 30.

The above-described problem may cause a malfunction of the conventional electro-photographic printer, which requires an entire waste toner transfer unit of the conventional electro-photographic printer to be replaced with a new one or requires the conventional electro-photographic printer to be taken apart and then fixed. Therefore, it is necessary to develop an apparatus for preventing the foreign substances from accidentally going into the duct 30 via the waste toner injection hole 31.

SUMMARY OF THE INVENTION

In order to solve the foregoing and/or other problems, it is an aspect of the present general inventive concept to provide an electro-photographic printer having a foreign substance prevention device, which prevents foreign substances from accidentally going into a duct via a waste toner injection hole exposed to an outside of the printer when a photosensitive medium is separated from a main body of the electro-photographic printer.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a foreign substance prevention unit of an electro-photographic printer, which prevents foreign substances from going into a waste toner transfer unit of the electro-photographic printer via a waste toner injection hole. The foreign substance prevention unit is installed over the waste toner injection hole such that it closes the waste toner injection hole when a photosensitive medium is separated from a main body of the electro-photographic printer and opens the waste toner injection hole when the photosensitive medium is installed in the main body of the electro-photographic printer, and is formed of an elastic material.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
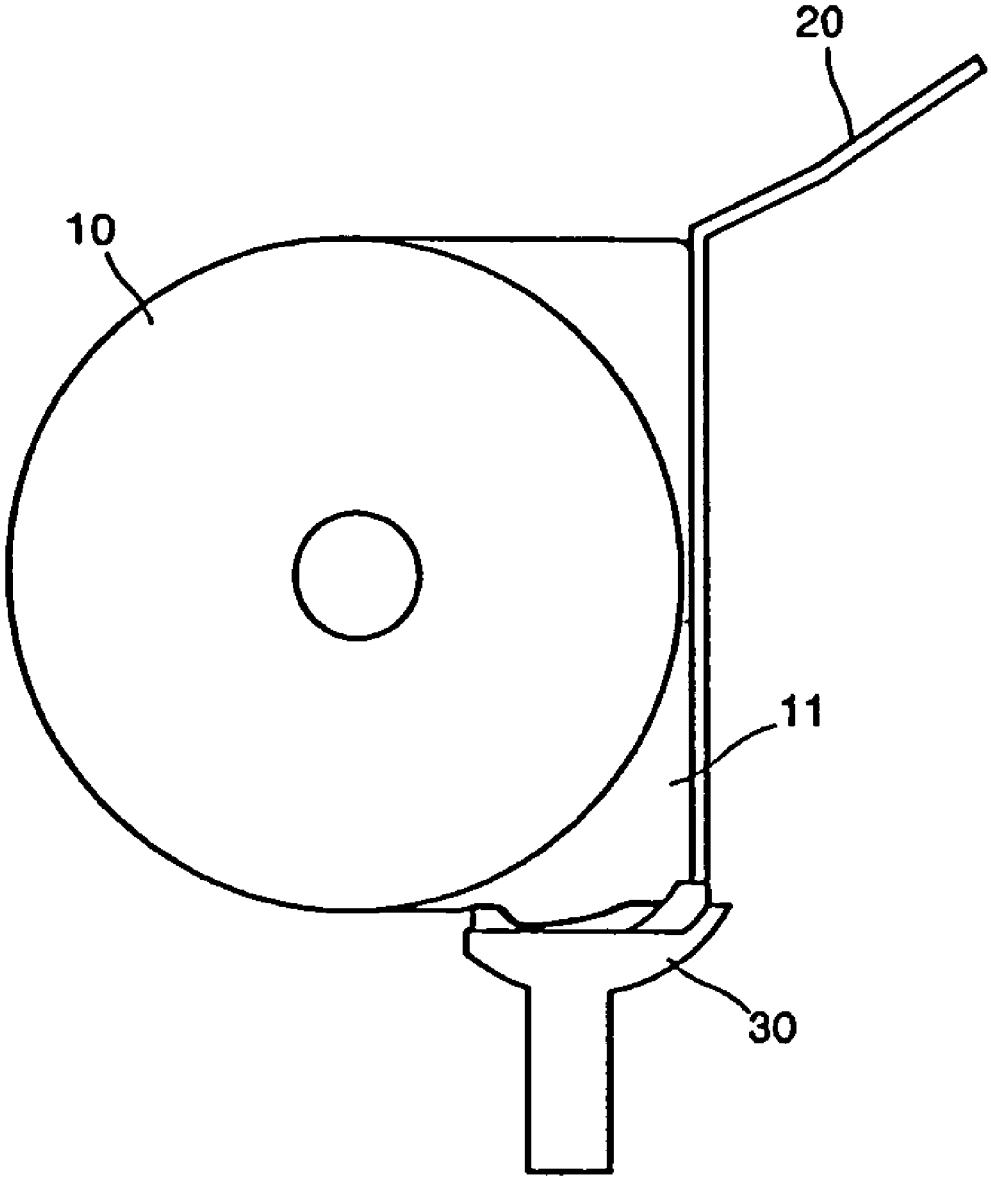
FIG. 1 (PRIOR ART)
FIG. 1 is a side view of a cleaning apparatus and a waste toner injection hole of a conventional electro-photographic printer.
Figure 2:
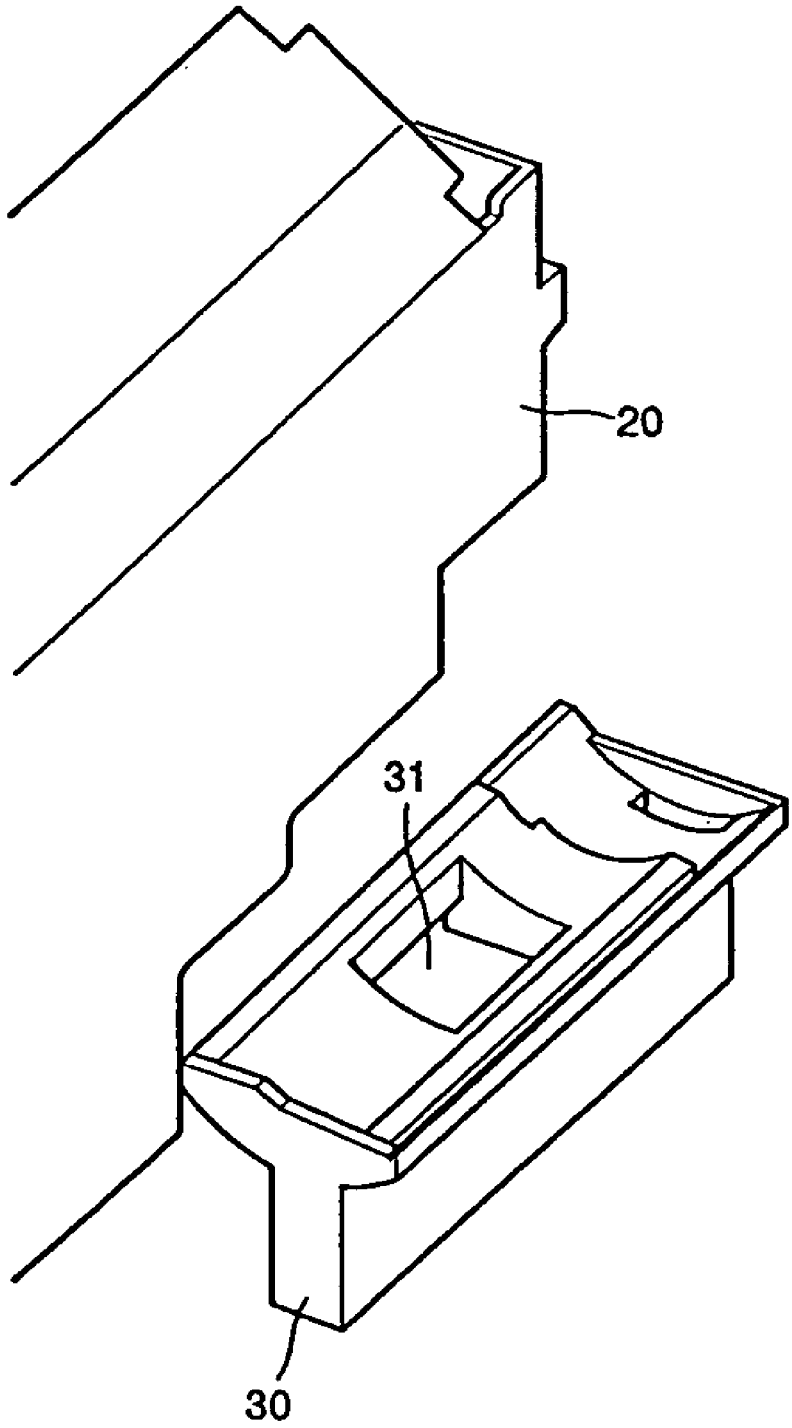
FIG. 2 (PRIOR ART)
FIG. 2 is a perspective view of the waste toner injection hole of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
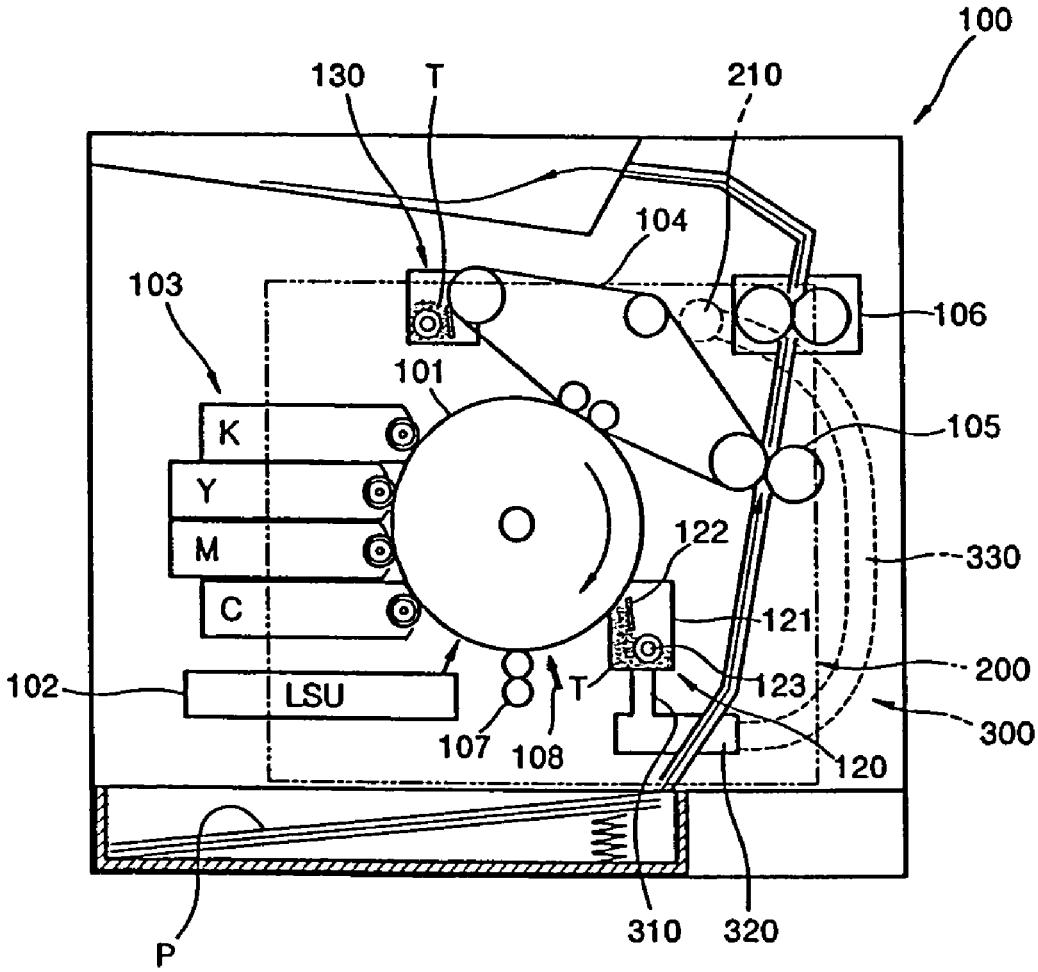
FIG. 3 is a schematic view of an electro-photographic printer according to an embodiment of the present general inventive concept.

Referring to FIG. 3, an electro-photographic printer 100 may include a photosensitive drum 101, a laser scanning unit 102, a developing unit 103, a transfer belt 104, and a fixing unit 106.

The photosensitive drum 101 can be formed by forming a photosensitive material layer on an outer circumferential surface of a metallic drum. The photosensitive drum 101 may be replaced with a photosensitive belt.

The laser scanning unit (LSU) 102 can form a latent electrostatic image by scanning a laser beam corresponding to image information onto the photosensitive drum 10, which is electrified to have a uniform distribution of electrical potentials all over its surface.

The developing unit 103 can comprise four developers 103C, 103M, 103Y, and 103K, which respectively contain cyan (C), magenta (M), yellow (Y), and black (K) toner particles. The developing unit 103 provides the cyan (C), magenta (M), yellow (Y), and black (K) toner particles to the latent electrostatic image formed on the photosensitive drum 101, thereby forming cyan-, magenta-, yellow-, and black-colored toner images.

The transfer belt 104 can be an intermediate transfer medium, which transfers the toner images from the photosensitive drum 101 to a printing medium P. The transfer belt 104 may be replaced with a transfer drum.

The transfer belt 104 can sequentially transfer the cyan-, magenta-, yellow-, and black-colored toner images to the photosensitive drum 101 so that the cyan-, magenta-, yellow-, and black-colored toner images can overlap one another on the photosensitive drum 101. The overlapping cyan-, magenta-, yellow-, and black-colored toner images form a color toner image. Preferably, but not necessarily, a speed of the transfer belt 104 is equal to a linear rotation speed of the photosensitive drum 101. A length of the transfer belt 104 can be longer than or at least equal to a length of the printing medium P, onto which the color toner image will be eventually transferred.

Reference numeral 105 denotes a transfer roller. The transfer roller 105 can be installed in the electro-photographic printer 100 to face the transfer belt 104. The transfer roller 105 can be spaced-apart from the transfer belt 104 by a predetermined distance when the color toner image is transferred to the transfer belt 104. However, once the transfer of the color toner image to the transfer belt 104 is complete, the transfer roller 105 can firmly contact the transfer belt 104 with a predetermined pressure in order to transfer the color toner image transferred to the transfer belt 104 to the printing medium P.

The fixing unit 106 can fix the color toner image onto the printing medium P by applying heat and pressure to the printing medium P, onto which the color toner image has already been transferred.

Reference numeral 107 denotes a charging unit, which electrifies the photosensitive drum 101 to have a uniform distribution of electrical potentials all over its surface, and reference numeral 108 denotes a discharging unit, which removes an electrical charge remaining on the photosensitive drum 101.

An operation of the electro-photographic printer 100 will now be described in greater detail.

The electro-photographic printer 100 can sequentially transfer the cyan-, magenta-, yellow-, and black-colored toner images to the transfer belt 104 so that the cyan-, magenta-, yellow-, and black-colored toner images can overlap one another on the transfer belt 104. Thereafter, the electro-photographic printer 100 transfers the overlapping cyan-, magenta-, yellow-, and black-colored toner images to the printing medium P and then fixes them onto the printing medium P, thereby forming the color toner image.

When the laser scanning unit 102 scans an optical signal (light) corresponding to the cyan-colored image information onto the photosensitive drum 101, which is electrified to have a uniform distribution of electrical potentials all over its surface, a resistance of portions of the photosensitive drum 101 light-scanned by the laser scanning unit 102 decreases, and electrical charges gradually drain from an outer circumferential surface of the photosensitive drum 101. Accordingly, an electrical potential difference is produced between the portions of the photosensitive drum 101 light-scanned by the laser scanning unit 102 and other potions of the photosensitive drum 101 yet to be light-scanned by the laser scanning unit 102, thus forming the latent electrostatic image on the outer circumferential surface of the photosensitive drum 101.

When the latent electrostatic image approaches the developer 103C due to a rotation of the photosensitive drum 101, the cyan-colored toner contained in the developer 103C can be attached to the latent electrostatic image, thereby forming the cyan-colored toner image. When the cyan-colored toner image approaches the transfer belt 104 due to the rotation of the photosensitive drum 101, the cyan-colored toner image can be transferred onto the transfer belt 104 due to the electrical potential difference between the photosensitive drum 101 and the transfer belt 104 and/or a contact pressure therebetween. When the cyan-colored toner image is completely transferred onto the transfer belt 104, the magenta-, yellow-, and black-colored toner images can sequentially be formed and then sequentially transferred onto the transfer belt 104 so that the cyan-, magenta-, yellow-, and black-colored toner images can overlap one another on the transfer belt 104. The overlapping cyan-, magenta-, yellow-, and black-colored toner images on the transfer belt 104 can form the color toner image. When the printing medium P passes between the transfer belt 104 and the transfer roller 105, the color toner image can be transferred onto the recording medium P. Thereafter, the fixing unit 106 can fix the color toner image onto the printing medium P by applying heat and pressure and then discharges the resulting printing medium P, thus completing an entire process of forming a color image on the recording medium P.

The cyan-, magenta-, yellow-, and black-colored toner images can temporarily be contained in the photosensitive drum 101 and then in the transfer belt 104. In a process of transferring the cyan-, magenta-, yellow-, and black-colored toner images from the photosensitive drum 101 to the transfer belt 104 or from the transfer belt 104 to the printing medium P, some toner particles may remain on the photosensitive drum 101 or the transfer belt 104.

Referring to FIG. 3, the electro-photographic printer 100 can include cleaning units 120 and 130 which remove a waste toner from the photosensitive drum 101 and the transfer belt 104, respectively, and a waste toner transfer unit 300 which transfers the waste toner removed from the photosensitive drum 101 and the transfer belt 104 by the cleaning units 120 and 130, respectively, and a container 200 which stores the waste toner transferred by the waste toner transfer unit 300.

The cleaning unit 120 can include a housing 121, a blade 122 which contacts the photosensitive drum 101 and scrapes the waste toner off the photosensitive drum 101, and a transfer unit 123 which transfers the waste toner to a discharger 123 disposed at one end of the housing 121. The cleaning unit 130 may have the same structure as the cleaning unit 120. A reference character T denotes the waste toner collected in to the cleaning unit.

An injection hole 210 can be formed on a top surface of the container 200 so that the container can efficiently accept and contain the waste toner. In this embodiment, the transfer belt 104 can be located above the photosensitive drum 101, and thus, the waste toner removed from the transfer belt 104 by the cleaning unit 130 can be directly injected into the container 200 from the cleaning unit 130 via an injection hole (not shown).

The waste toner removed from the photosensitive drum 101 by the cleaning unit 120, unlike the waste toner removed from the transfer belt 104 by the cleaning unit 130, can be transferred from the cleaning unit 120 to the container 200 by the waste toner transfer unit 300 rather than being directly injected into the container 200, because there is a difference between a height of the injection hole of the container 200 and a height of the cleaning unit 120.

The waste toner transfer unit 300 can include a duct and a transfer screw. The duct can comprise first through third sub-ducts 310, 320, and 330. The first sub-duct 310 connects the cleaning unit 120 to the second sub-duct 320. A waste toner injection hole 311 of FIG. 4, through which the waste toner removed from the photosensitive drum 101 by the cleaning unit 120 is discharged, can be formed on a top of the first sub-duct 310. The third sub-duct 330 can be formed as a circular pipe which can be easily bent to connect the second sub-duct 320 and the container 200. The transfer screw can be installed in the duct and transfers the waste toner injected into the duct via the waste toner injection hole 311 to the container 200.

Referring to FIGS. 4 through 7, a foreign substance prevention unit 350, which prevents foreign substances from going into the waste toner transfer unit 300 via the waste toner injection hole 311, can be disposed over the waste toner injection hole 311.

One end of the foreign substance prevention unit 350 can be fixed to a bracket 340 installed in the main body of the electro-photographic printer 100, and the other end of the foreign substance prevention unit 350 can be located over the waste toner injection hole 311.

The foreign substance prevention unit 350 can be, but not necessarily, formed of a flexible and elastic material, for example, plastic, because the foreign substance prevention unit 350 should not be an obstacle to installation/separation of the photosensitive drum 101 into/from the main body of the electro-photographic printer 100.

Figure 4:
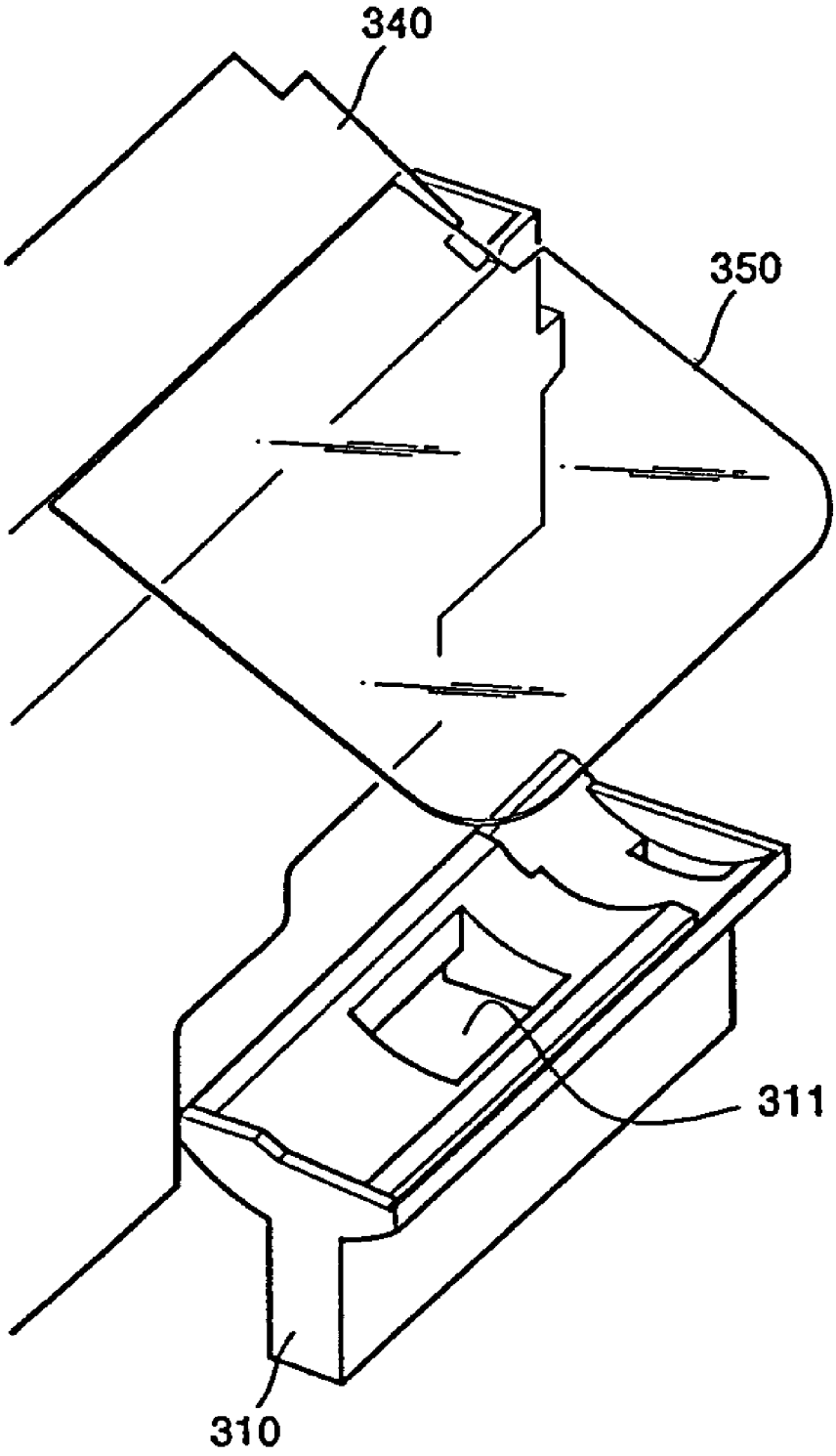
FIG. 4 is a perspective view of a foreign substance prevention device when a photosensitive medium is separated from a main body of the electro-photographic printer of FIG. 3.
Figure 5:
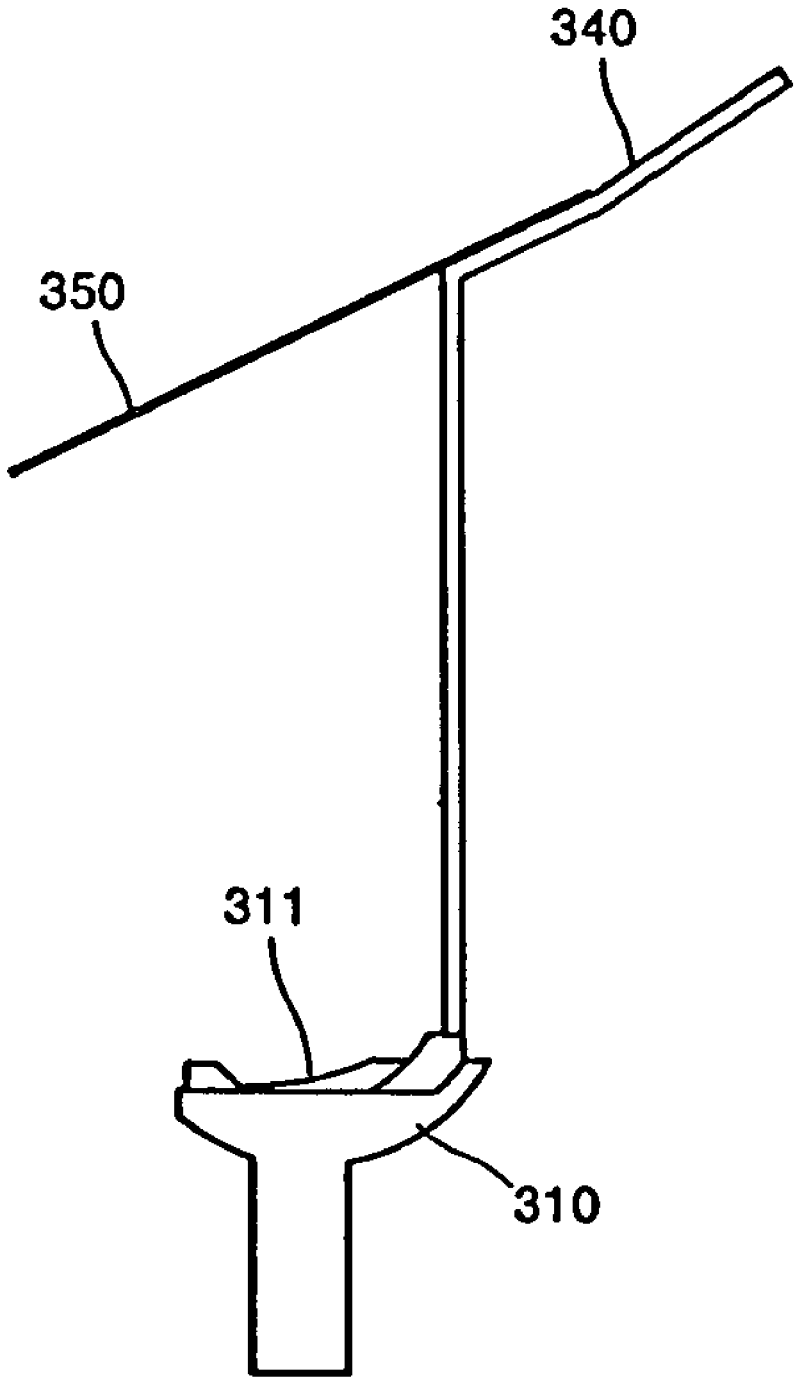
FIG. 5 is a side view of a foreign substance prevention device when a photosensitive medium is separated from a main body of the electro-photographic printer of FIG. 3.

As shown in FIGS. 4 and 5, when the photosensitive drum 101 is separated from the main body of the electro-photographic printer 100, the foreign substance prevention unit 350 can cover the waste toner injection hole 311 so that the foreign substances from an outside of the electro-photographic printer 100 can be prevented from going into the waste toner transfer unit 300 via the waste toner injection hole 311.

Figure 6:
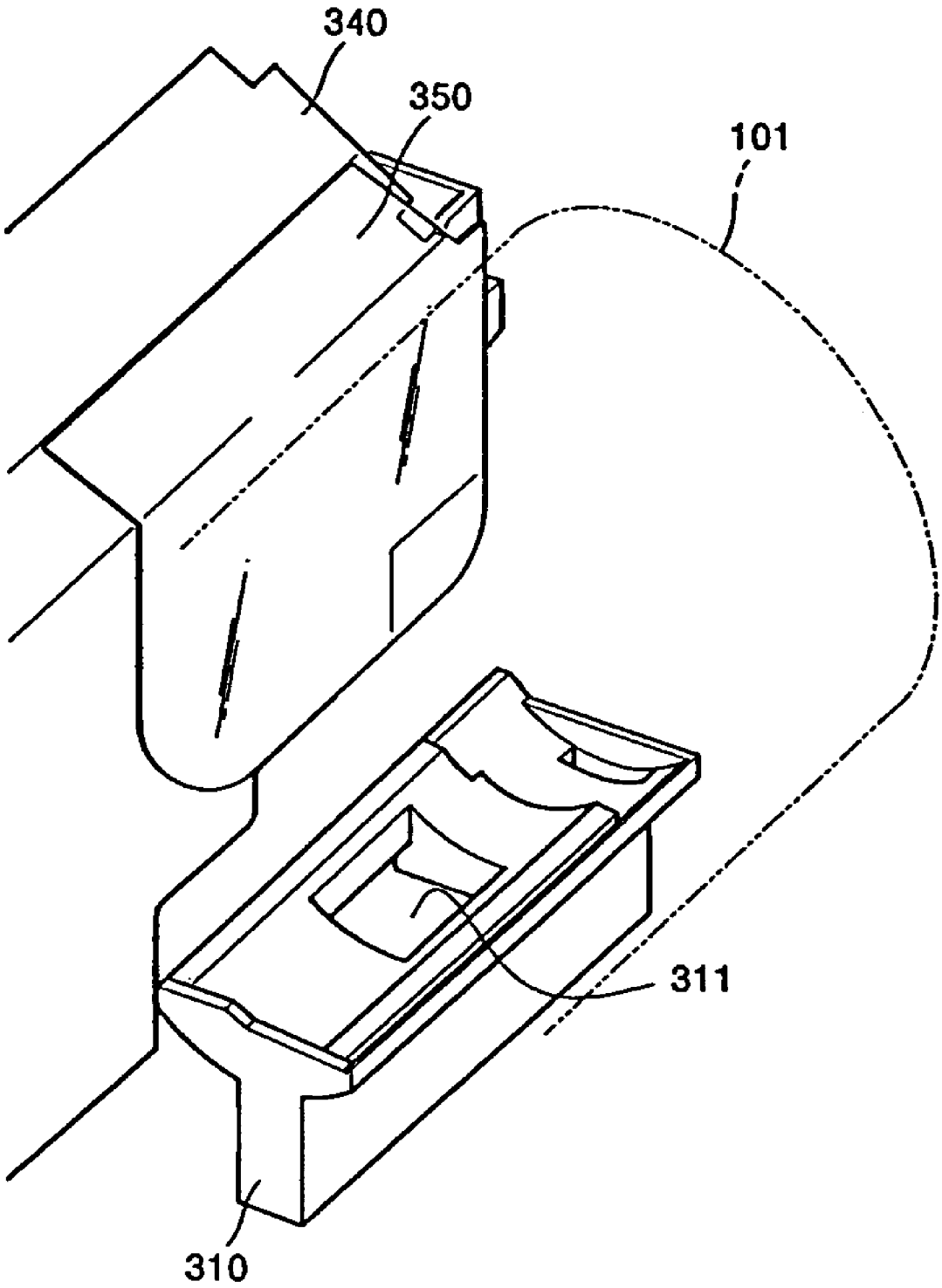
FIG. 6 is a perspective view of a foreign substance prevention device when a photosensitive medium is installed in a main body of the electro-photographic printer of FIG. 3.
Figure 7:
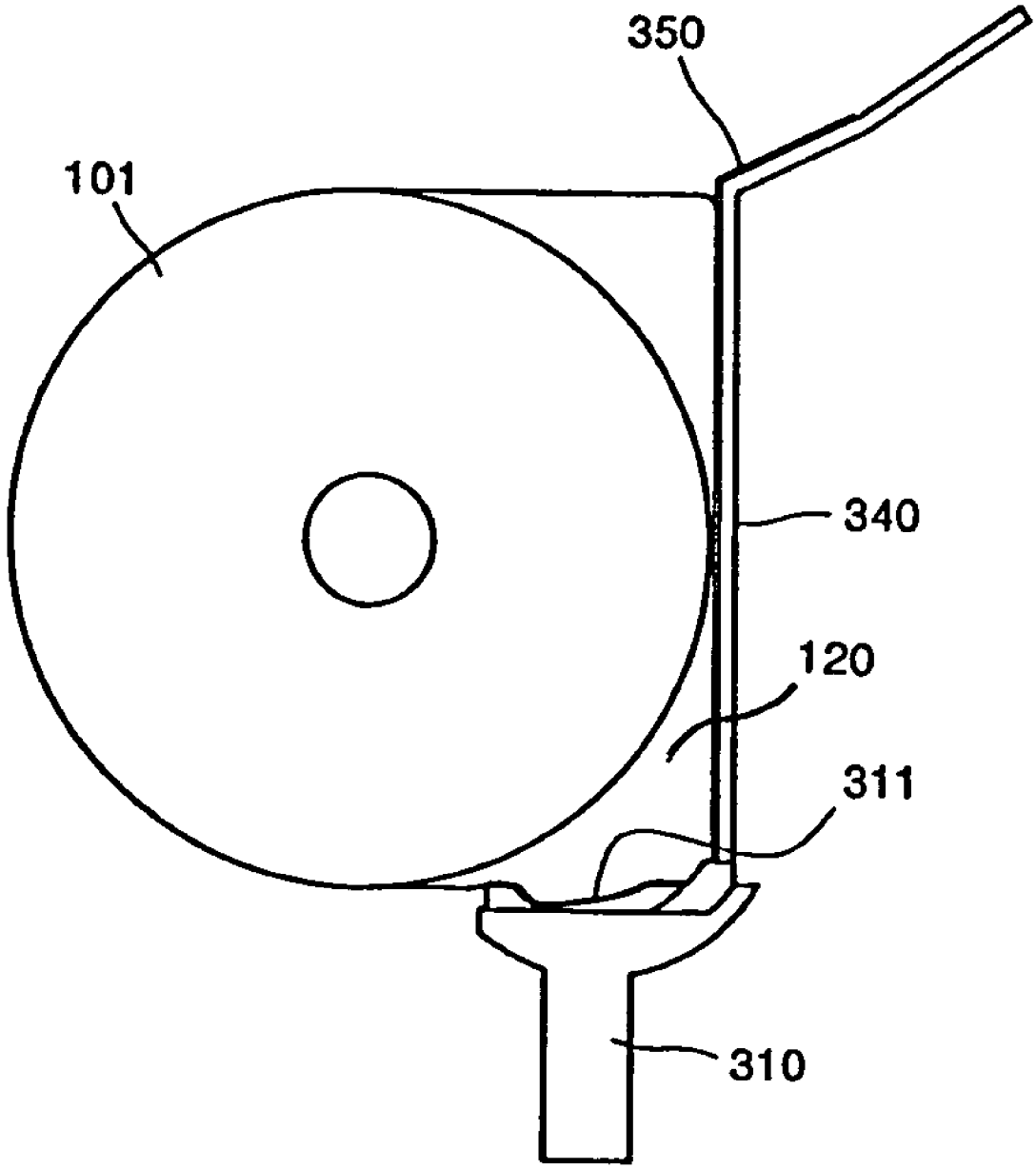
FIG. 7 is a side view of a foreign substance prevention device when a photosensitive medium is installed in a main body of the electro-photographic printer of FIG. 3.

As shown in FIGS. 6 and 7, when the photosensitive drum 101 is installed in the main body of the electro-photographic printer 100, the foreign substance prevention unit 350 can contact the photosensitive drum 101 and then is bent and folded due to a contact force therebetween such that it does not serve as an obstacle to connection of the cleaning unit 120 to the waste toner injection hole 311.

Thereafter, when the photosensitive drum 101 is separated from the main body of the electro-photographic printer 100, the foreign substance prevention unit 350 can return to its original state illustrated in FIG. 4 or 5 due to its elasticity.

As described above, a foreign substance prevention unit of an electro-photographic printer according to the present general inventive concept can prevent foreign substances from accidentally going into a waste toner transfer unit when a photosensitive drum is installed in or separated from a main body of the electro-photographic printer and thus can prevent the waste toner transfer unit from being blocked by the foreign substances.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electro-photographic printer having a photosensitive medium installed in a main body, comprising:

a waste toner transfer unit having a waste toner injection hole through which a waste toner is received; and a foreign substance prevention unit which is installed over the waste toner injection hole to close the waste toner injection hole when a photosensitive medium is separated from a main body, and to open the waste toner injection hole when the photosensitive medium is installed in the main body so that a foreign substance is prevented from being introduced into the waste toner transfer unit, and is formed of an elastic material.

2. The electro-photographic printer of claim 1, wherein one end of the foreign substance prevention unit is fixed to a bracket so that the foreign substance prevention unit can contact the photosensitive medium and then be folded when the photosensitive medium is installed in the main body, and so that the foreign substance prevention unit can return to its original state when the photosensitive medium is separated from the main body.

3. The electro-photographic printer of claim 2, wherein the foreign substance prevention unit is driven by the photosensitive medium which is installed in or separated from the main body.

4. An electro-photographic printer having a main body and a medium installed in the main body to form a toner image, comprising:

a cleaning unit to remove a waste toner from a medium transferring a toner image;

a container to store the waste toner;

a waste toner transfer unit to transfer the waste toner from the cleaning unit to the container;

a waste toner injection hole formed on the waste toner transfer unit and adjacent to the cleaning unit to receive the waste toner from the cleaning; and a foreign substance prevention unit to close and open the waste toner injection hole according to a movement of the medium with respect thereto.

5. The electro-photographic printer of claim 4, wherein the foreign substance prevention unit is installed over the waste toner injection hole.

6. The electro-photographic printer of claim 4, wherein the foreign substance prevention unit closes the waste toner injection hole when the medium is separated from a main body, and opens the waste toner injection hole when the medium is installed in the main body so that a foreign substance is prevented from being introduced into the waste toner transfer unit.

7. The electro-photographic printer of claim 4, wherein the foreign substance prevention unit is made of an elastic material.

8. The electro-photographic printer of claim 4, wherein the foreign substance prevention unit comprises a first end fixedly coupled to a main body and a second end extended from the first end to move between a first position to close the waste toner injection hole of the waste toner transfer unit, and a second position to open the waste toner injection hole of the waste toner transfer unit.

9. The electro-photographic printer of claim 4, wherein the foreign substance prevention unit comprises a first end fixedly coupled to a main body and a second end extended from the first end to move with respect to the waste toner injection hole of the waste toner transfer unit.

10. The electro-photographic printer of claim 4, wherein the foreign substance prevention unit comprises a first end fixedly coupled to a main body and a second end extended from the first end to move according to a contact force between the medium and the second end.

11. The electro-photographic printer of claim 4, wherein the foreign substance prevention unit comprises a first end fixedly coupled to a main body and a second end extended from the first end to move according to an installation of the medium in a main body, the second end of the foreign substance prevention unit having an area larger than an area of the waste toner injection hole.

12. The electro-photographic printer of claim 4, wherein the medium occupies a space of a main body when the medium is installed in the main body, and the foreign substance prevention unit moves between a first position disposed in the space and a second position disposed outside the space.

13. The electro-photographic printer of claim 4, wherein the medium occupies a space of a main body when the medium is installed in the main body, and the foreign substance prevention unit comprises a first end fixedly coupled to a main body and a second end extended from the first end to move between a first position disposed in the space and a second position disposed outside the space.

14. The electro-photographic printer of claim 4, wherein the medium has a first length in a direction parallel to a rotation axis of the medium, and the foreign substance prevention unit has a second length less than the first length in the direction.

15. An electro-photographic printer, comprising:

a main body;

a photosensitive medium disposable in and separable from the main body at a predetermined space in the main body;

a waste toner transfer unit adjacent to the photosensitive medium and having a waste toner injection hole through which a waste toner is received; and a foreign substance prevention unit which is installed over the waste toner injection hole to be movable by the photosensitive medium between a first position disposed in the predetermined space when the photosensitive medium is separated from the main body and to a second position disposed outside the predetermined space when the photosensitive medium is disposed in the main body.

16. An electro-photographic printer, comprising:

a main body;

a medium installed in the main body to form a toner image;

a waste toner collection unit disposed adjacent to the medium and having an injection hole to collect wasted toner; and a foreign substance prevention unit comprising a resilient material attached to the main body to extend over the injection hole adjacent to the medium to close and open the injection hole.

17. The electrophotographic printer of claim 16, wherein in a first state the foreign substance prevention unit is bent to an "L" shape by the medium to open the injection hole, and in a second state the foreign substance prevention unit is restored to a flat shape by a resiliency thereof to close the injection hole.

* * * * *